United States Patent [19]

Strewe et al.

[11] 4,342,630

[45] Aug. 3, 1982

[54] BRINE DISTRIBUTION SYSTEM FOR ELECTROLYTIC CELLS

[75] Inventors: Wolfgang Strewe; Luciano Mose, both of Dortmund; Bernd Strasser, Hamm, all of Fed. Rep. of Germany

[73] Assignee: Hooker Chemicals & Plastics Corp., Niagara Falls, N.Y.

[21] Appl. No.: 179,903

[22] Filed: Aug. 20, 1980

[30] Foreign Application Priority Data

Aug. 23, 1979 [DE] Fed. Rep. of Germany ..... 2934108

[51] Int. Cl.[3] ..... C25B 1/34; C25B 9/00; C25B 1/02

[52] U.S. Cl. ..... 204/98; 204/128; 204/129; 204/263; 204/266

[58] Field of Search ..... 204/98, 128, 129, 257, 204/263, 266, 255

[56] References Cited

U.S. PATENT DOCUMENTS

| | | | |
|---|---|---|---|
| 1,335,338 | 3/1920 | Jenkins | 204/257 |
| 3,072,545 | 1/1963 | Juda et al. | 204/257 |
| 3,558,466 | 1/1971 | Lebrizzi et al. | 204/263 |
| 4,196,069 | 4/1980 | Mose et al. | 204/257 |
| 4,202,752 | 5/1980 | Sherwood et al. | 204/263 |

*Primary Examiner*—R. L. Andrews

*Attorney, Agent, or Firm*—Howard M. Ellis

[57] ABSTRACT

Electrolytic cells demonstrate improved performance through use of an internal brine distribution system. A brine distributor located in the interior of the cell and positioned either at the cell bottom or above the cell's electrodes has individual brine outlets for feeding electrolyte directly to each of the cell's anolyte compartments for electrolysis. By comparison with conventional brine feed systems, e.g. cell top feed, the internal brine distributor produces higher purity gas, e.g. chlorine, at reduced power consumption and higher current efficiencies.

20 Claims, 2 Drawing Figures

BRINE DISTRIBUTION SYSTEM FOR ELECTROLYTIC CELLS

BACKGROUND OF THE INVENTION

The present invention relates to an improved apparatus for making halogen gas, e.g. chlorine, alkali metal hydroxide and hydrogen electrolytically in a diaphragm type chlor-alkali cell equipped with a novel brine feed distribution system. The cell comprises a unitary container having a base for retaining a plurality of metal anodes, a cathode can and a cell cover. A plurality of repeating reaction zones are formed within the cell, each zone comprising an anode compartment having a dimensionally stable metal anode, a cathode compartment having a foraminous metallic cathode and a diaphragm separating both anode and cathode compartments. One or more interior brine feed distribution lines at the top or bottom of the cell has individual outlets adjacent to such reaction zones for feeding brine evenly to the anolyte compartment of each reaction zone. On the application of direct electrolyzing current to aqueous solutions of alkali metal chloride, hydrogen and alkali metal hydroxide are produced at the cathode and chlorine, substantially free of oxygen and other gas impurities, is produced at the anode.

Electrolytic cells commonly employed commercially for the conversion of alkali metal chlorides into alkali metal hydroxides and chlorine may be considered to fall into the following general categories: (1) diaphragm, (2) mercury, and (3) membrane cells.

Diaphragm cells utilize one or more separators permeable to the flow of electrolyte solution but impervious to the flow of gas bubbles. The diaphragm separates the cell into two or more compartments. Although diaphragm cells achieve relatively high product per unit floor space, at low energy requirements and at generally high current efficiency, the alkali metal hydroxide product, or cell liquor, must be concentrated and purified. Such concentration and purification is usually accomplished by a subsequent evaporation step.

Mercury cells typically utilize a moving or flowing bed of mercury as the cathode and produce an alkali metal amalgam in the mercury cathode. Halide gas is produced at the anode. The amalgam is withdrawn from the cell and treated with water to produce a high purity alkali metal hydroxide.

Membrane cells utilize one or more membranes or barriers separating the catholyte and the anolyte compartments. The membranes are permselective, that is, they are selectively permeable to either anion or cation. Generally, the permselective membranes utilized are cationically permselective. Usually, the catholyte product of the membrane cell is of a relatively high purity alkali metal hydroxide, ranging in concentration from about 250 to about 350 gpl.

Chlorine and alkali metal hydroxides are essential and large volume commodities and are recognized as basic industrial chemicals. Plants producing 500 to 1,000 tons of chlorine per day are not uncommon. Such plants typically utilize a large number of individual electrolytic cells having high current capacities. Thus, seemingly even minor improvements in individual cell operation or performance will have major economic benefits because of the volume of products produced. For example, currently metallic anodes are used almost exclusively in diaphragm cells for the electrolysis of alkali metal chloride. Compared with diaphragm cells equipped with graphite anodes, metallic anodes provide lower cell voltages, and correspondingly, lower current consumption under otherwise identical operating conditions. The lower cell voltages are achieved by narrower distances or gaps between individual anodes and cathodes.

Notwithstanding the substantial improvements made in lowering power consumption in the operation of diaphragm cells, with ever increasing energy costs further attempts are being made to reduce the current consumption by operating the cells at lower current densities, i.e. . . . at lower current intensity per surface unit. For example, it would be possible to reduce the cell voltage from about 3.4 volts to about 3.1 volts by reducing the current density from the currently standard value of about 2.3 $kA/m^2$ to 1.5 $kA/m^2$. This is equivalent to a theoretical electrical saving of about 10 percent. In reality, the saving in electricity is, however, much smaller mainly because of secondary reactions. Generation of anodic oxygen occurs increasingly with a decrease in current density, which results in a reduction in the amount of chlorine generated per KWH. Therefore, not only is it impossible to reach the theoretically possible power savings, but the purity of the gaseous chlorine produced in such cells also diminishes due to the increasing concentration of oxygen.

Accordingly, it has now been discovered that further improvements in electrical power savings and product purities can be achieved by feeding alkali metal chloride brine evenly into the individual anolyte compartments of an electrolytic cell. In practice, at least one brine feed conduit or brine distributor located below or above the cell's electrodes discharges brine to individual reaction zones. Sparging electrolyte directly into the reaction zones provides higher current efficiencies and higher chlorine purity.

Previous methods call for filling the cell container with electrolyte solution to above the top edge of the electrodes. Fresh brine is continuously fed onto the surface of the brine charge by means of a pipe opening in the cover of the cell or conduit in the bottom of the cell container. In each instance, however, power consumption is high and/or chlorine purity is low.

Thus, the present invention has as its principal objective improving the current efficiency and the concentration of chlorine produced in cells equipped with metallic anodes, especially during operation of cells at lower current densities.

Yet, still another object of the present invention is an improved diaphragm cell in the electrolytic production of chlorine, caustic soda and hydrogen.

These and other objects, features and advantages of this invention will become apparent to those skilled in the art after a reading of the following description.

GENERAL DESCRIPTION OF THE INVENTION

The present invention provides a means for feeding brine evenly and equally through an electrolytic cell. The cell, comprising a container housing a plurality of reaction zones wherein each zone has an anode compartment housing a metallic anode, a cathode compartment housing a metallic cathode, each anode and cathode member being separated along their active surfaces by a barrier, for example, an asbestos diaphragm, polymer reinforced asbestos diaphragms, such as those available under the "HAPP" trademark from Hooker Chemicals & Plastics Corp., fluoropolymer based microporous separators or permselective membrane barriers.

The electrolytic cell includes means for feeding alkali metal chloride brine, e.g. . . . sodium or potassium chloride, from above or below the electrode compartment from a common header or distributor which sparges electrolyte to the anolyte compartment of each of the reaction zones through multiple outlets in the distributor(s).

The brine feed conduit or distributor is located in the interior of the cell container and runs parallel to the longitudinal axis of the cell in a space between the lower edge of the electrodes and the cell base or alternatively in the head space above the electrodes.

DETAILED DESCRIPTION OF THE INVENTION

The present invention will now be described in greater detail by reference to the accompanying drawings.

Figure 1:
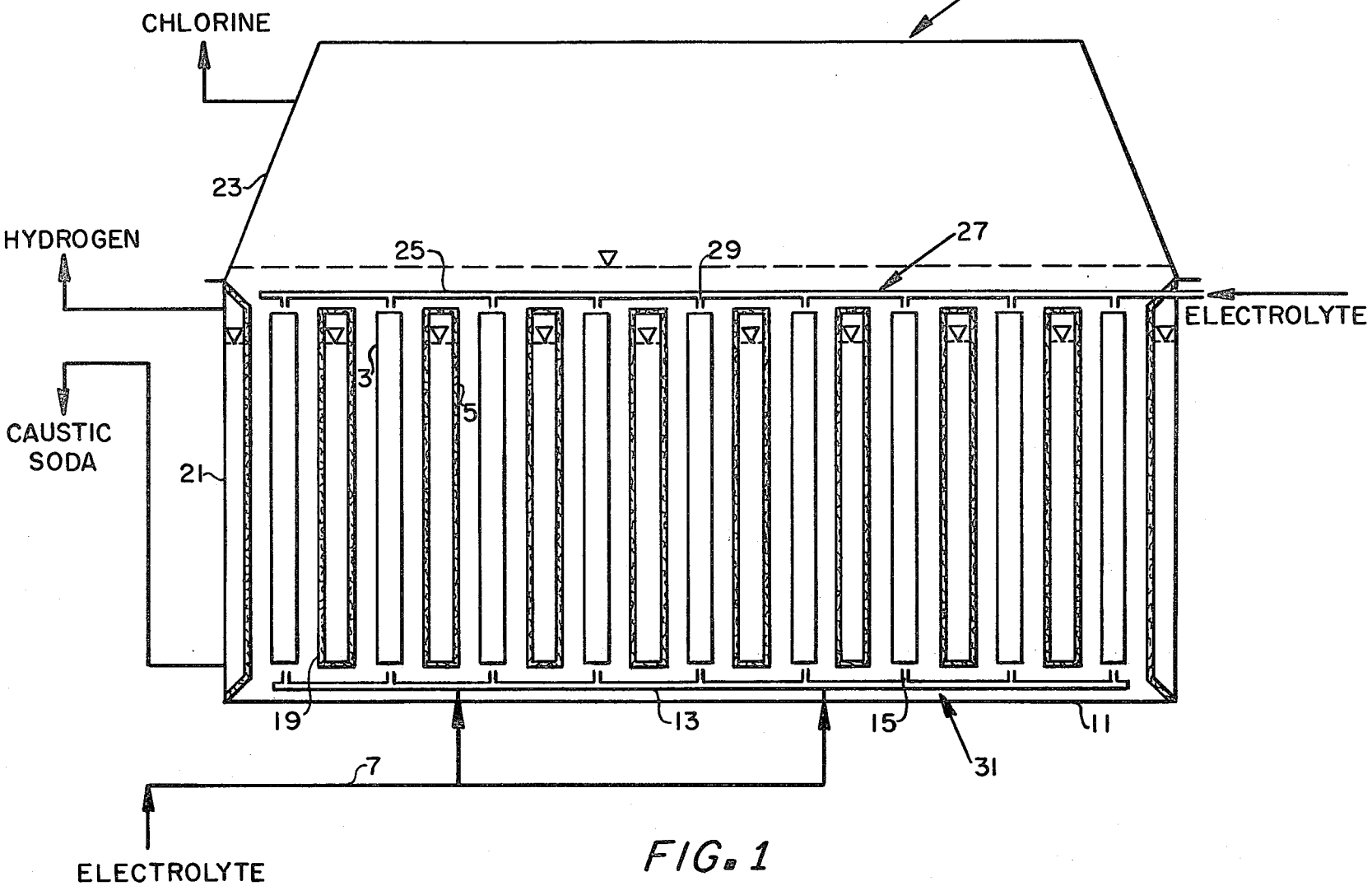
FIG. 1 represents a side view of an electrolytic cell having the brine distribution system of the present invention.

Referring first to FIG. 1, a diaphragm cell 1 is shown containing a plurality of boxed shaped, dimensionally stable metal anodes 3 connected by means of titanium clad copper riser posts 17 (FIG. 2) to cell base 11. Such anode members may be foraminous or in the form of a sheet or plate and are preferably fabricated from a valve metal base which have an electrically conductive, anodically-resistant coating applied to its active anodic or unoxidized surface. Suitably, valve metals include titanium, tantalum, niobium and zirconium. The preferred valve metal is titanium. The coating preferably contains one or more platinum-group metals and/or platinum-group metal oxides. Suitably platinum-group metals include platinum, ruthenium, rodium, palladium, osmium and iridium. Any of various methods can be used for applying the coating onto the valve metal base. Typical methods include precipitation of the metals or metallic oxides by chemical, thermal or electrolytic processes, iron plating, vapor deposition or the like.

A cathode container or can 21 provides foraminous, metallic cathodes 5 in alternating relationship with anodes 3. Cathode members are suitably fabricated of steel, however, chromium, cobalt, copper, iron, lead, molybdenum, nickel, tin, tungsten or alloys thereof can also be used. The cathode members in addition to being foraminous may also be in the form of a sheet or plate.

A cell separator 19 consisting of either a microporous separator of a fluorocarbon polymer, e.g. . . . PTFE, or asbestos or polymer reinforced asbestos, is deposited or fitted onto cathode 5. A conventional cell top 23 is shown in FIG. 1. An example of such an electrolytic cell would be the Hooker-type H-4 diaphragm type chlor-alkali cell. In operation of a circuit of such diaphragm cells to electrolyze sodium chloride, an anolyte feed, comprising an aqueous solution of brine containing from about 100 to about 310 gpl sodium chloride is introduced in each of the reaction zones. When an electrolyzing source of current is imposed on the circuit chlorine is formed at the anode while sodium hydroxide and hydrogen are formed at the cathode.

According to the present invention electrolyte which may consist of an aqueous solution of an alkali metal chloride, e.g. NaCl, KCl, etc. is fed to the cell via a lower brine distribution system 31 which is located in the lower interior region of the cell beneath the electrodes 3 and 5. Alternatively, an upper brine distribution system 27 may be positioned above the vertically disposed electrodes.

Figure 2:
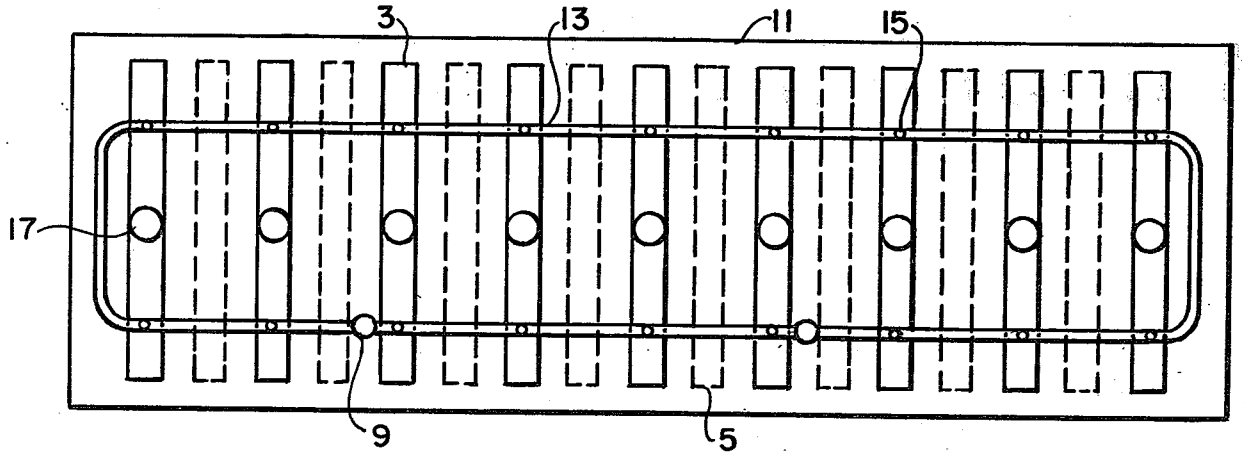
FIG. 2 represents a top view of the cell of FIG. 1.

FIG. 2 illustrates one embodiment of the brine distribution system consisting of a rectangular shaped brine distributor 13 located within the interior of the cell which discharges fresh brine into individual anode compartments of the electrolysis-reaction zones through a plurality of brine distributor outlets 15 and 29, said outlets being located either below or above the anode compartments depending on which embodiment of the invention is being utilized. Although FIG. 2 illustrates a single rectangular shaped brine distributor 13, other configurations of distributors may also be employed, including substantially linear shaped distributors which run parallel to the longitudinal axis of the cell. In each instance, the distributor will have at least one of outlets 15 or 29 feeding electrolyte to each of the anolyte compartments of the cell.

Electrolyte may be fed to the internal brine distribution system by any number of means, such as by exteriorly located conduit 7 below cell base 11 which channels brine to the distributor 13 through brine feed conduit connection 9 consisting of one or more T-joints (not shown).

The materials of construction for the brine distribution system are available materials known to persons skilled in the art as being capable of withstanding the highly corrosive environment of a chlor-alkali cell. For example, the brine distributor may be fabricated from chlorinated polyvinyl chloride, partially fluorinated or perfluorinated plastics, such as polytetrafluoroethylene, which are most preferred. Hard rubbers, and certain metals such as tantalum or platinized titanium would also be acceptable, however, plastics would be preferred.

The following specific example demonstrates the apparatus of the present invention, however, it is to be understood that this example is for illustrative purposes only and does not purport to be wholly definitive as to conditions and scope.

EXAMPLE

An experiment was conducted with the present invention comparing it with conventional brine feed systems. Four diaphragm type electrolytic cells were used for the experiment; three were conventional cells and one was equipped with a brine distribution system according to the present invention. In the three conventional cells, the electrolyte was charged into the cell container via two feed lines 9 (FIG. 2) from main brine feed line 7 (FIG. 1), but without any internal distributing device. In the cell equipped according to the present invention electrolyte distributing conduits were installed in such a manner that one feed line was installed under each half anode i.e. . . . laterally from anode riser 17 for each individual reaction zone. In order to guarantee an even flow of electrolyte into all reaction zones, the cross-sections of each discharge opening 15, of which there were 108, was chosen to be about one 1/100 of the cross-section of the distributor conduit 13. The cells were equipped with boxed type dimensionally stable anodes as well as diaphragms made of polymer reinforced asbestos.

The cells were put in to operation and all were adjusted to the same current density of 1.51 $kA/m^2$ and to the same brine feed rate of 730 liters per hour.

Immediately after the cells were put into operation, comparative measurements were carried out. The results obtained for the four cells are shown in Table 1 below.

TABLE 1

| | Experimental Cell | | | |
|---|---|---|---|---|
| | 1 | 2 | 3 | 4 |
| | Without special electrolyte distribution | | | With special electrolyte distribution |
| Cell load, kA | | 70 | | |
| Anode surface, m | | 46.4 | | |
| Brine feed rate, l/hr | | 730 | | |
| Brine concentration, g NaCl per liter | | 310 | | |
| Number of anodes | | 54 | | |
| Number of brine feed pipes | 2 | 2 | 2 | 108 |
| Weight of the diaphragm, kg | 76 | 77 | 72 | 77 |
| Chlorine concentration, vol. % | | | | |
| After 0.5 hr | | | 98.5 | |
| 1 | 98.5 | 97.3 | 98.3 | 99.2 |
| 1.5 | 98.3 | | 98.0 | |
| 2 | | 96.5 | 97.5 | 99.1 |
| 3 | 98.0 | 96.5 | | 98.5 |
| 4 | | 96.0 | 96.3 | |
| 7 | 95.0 | | | 97.2 |

All four cells had catholyte liquor concentrations of 160 gpl sodium hydroxide after four to six hours of operation. At this concentration cell number 4 equipped with the brine distributing device of the present invention maintained a chlorine concentration of 97.2 percent even during the subsequent operation period while the three other cells settled down to a chlorine concentration of only 95 to 96 percent.

Complete gas analysis, the current yield calculated from these analytical data, as well as the current consumption of the cell with the brine distributor and for the cells without such distributors are presented in Table 2 below.

TABLE 2

| Cell | Without | With | Brine distributor |
|---|---|---|---|
| Gas composition | | | |
| $Cl_2$ | 95.5 | 97.2 | Vol. % |
| $O_2$ | 3.99 | 2.29 | |
| $CO_2$ | 0.10 | 0.10 | |
| $H_2$ | 0.06 | 0.06 | |
| $N_2$ | 0.35 | 0.35 | |
| Current yield | 91.9 | 95.1 | % |
| Cell voltage | 3.21 | 3.21 | V |
| Current consumption | 2641 | 2552 | KWH/t $Cl_2$ |

The results demonstrate that an electrolytic cell equipped with the brine distribution system of the present invention provides greater current yield increases by 3.2 percent over cells not equipped with such system leading to a reduction of current consumption by about 90 KWH/t Cl. Thus, the use of the brine distribution system of the present invention leads to improvements in terms of current efficiency and impurity of the chlorine produced.

While the invention has been described in conjunction with a specific example thereof, this is illustrative only. Accordingly, many alternatives, modifications and variations will be apparent to those skilled in the art in light of the foregoing description, and it is therefore intended to embrace all such alternatives, modifications and variations as to fall within the spirit and broad scope of the appended claims.

We claim:

1. A method for making high purity chlorine, alkali metal hydroxide and hydrogen which comprises applying a decomposition voltage to an aqueous solution of alkali metal chloride in an electrolytic cell, said cell comprising in combination a unitary cell container having a cell base and a cell cover, said container housing a multiplicity of reaction zones wherein each zone comprises an anolyte compartment housing a metallic anode, a catholyte compartment housing a metallic cathode and a barrier separating the anolyte and catholyte compartment, said cell including a brine distribution system located in the interior of the cell non-integral with the container walls and positioned between the lower edges of the electrodes and the cell base, said brine distribution system having at least one common brine distributor manifold, said manifold equipped with multiple brine outlets located below the anolyte compartments and adapted to discharge brine below said compartments for upward movement into each of such anolyte compartments of the cell.

2. The method of claim 1 wherein the brine distributor manifold is a single or double line.

3. The method of claim 1 wherein the brine distributor manifold is substantially rectangular in shape.

4. The method of claim 1 wherein the barrier is asbestos or polymer reinforced asbestos.

5. The method of claim 1 wherein the barrier is a microporous fluorocarbon separator.

6. A method for making high purity chlorine, alkali metal hydroxide and hydrogen which comprises applying a decomposition voltage to an aqueous solution of alkali metal chloride in an electrolyte cell, said cell comprising in combination a unitary cell container having a cell base and a cell cover, said container housing a multiplicity of reaction zones wherein each zone comprises an anolyte compartment housing a metallic anode, a catholyte compartment housing a metallic cathode and a barrier separating the anolyte and catholyte compartments, said cell including a brine distribution system located in the interior of the container, said system having at least one brine distributor manifold equipped with brine outlets located above the reaction zones and adapted to feed brine evenly to each of the anolyte compartments.

7. The method of claim 6 wherein the brine distributor manifold is substantially rectangular in shape.

8. The method of claim 6 wherein the barrier is asbestos or polymer reinforced asbestos.

9. The method of claim 6 wherein the barrier is a microporous fluorocarbon separator.

10. An electrolytic cell for the electrolysis of an alkali metal halide which comprises in combination a unitary cell container having a cell base and a cell cover, said container housing a multiplicity of reaction zones wherein each zone comprises an anolyte compartment housing a metallic anode, a catholyte compartment housing a metallic cathode and a barrier separating the anolyte and catholyte compartments, said cell including a brine distribution system located in the interior of the cell non-integral with the container walls and positioned between the lower edges of the electrodes and the cell base, said brine distribution system having at least one common brine distributor manifold, said manifold equipped with multiple brine outlets located below the anolyte compartments and adapted to discharge brine below said compartments for upward movement into each of such anolyte compartments of the cell.

11. The electrolytic cell of claim 10 wherein the brine distributor manifold runs parallel to the longitudinal axis of the cell.

12. The electrolytic cell of claim 11 wherein the brine distributor manifold is a single or double line.

13. The electrolytic cell of claim 12 wherein the brine distributor manifold is substantially rectangular in shape.

14. The electrolytic cell of claim 10 wherein the barrier is asbestos or polymer reinforced asbestos.

15. The electrolytic cell of claim 10 wherein the barrier is a microporous fluorocarbon separator.

16. The electrolytic cell of claim 10 wherein the barrier is a permselective ion exchange membrane.

17. An electrolytic cell for the electrolysis of an alkali metal halide which comprises in combination a unitary cell container having a cell base and a cell cover, said container housing a multiplicity of reaction zones wherein each zone comprises an anolyte compartment housing a metallic anode, a catholyte compartment housing a metallic cathode and a barrier separating the anolyte and catholyte compartments, said cell including a brine distribution system located in the interior of the container, said system having at least one brine distributor manifold equipped with brine outlets located above the reaction zones and adapted to feed brine evenly to each of the anolyte compartments.

18. The electrolytic cell of claim 17 wherein the brine distributor manifold is substantially rectangular in shape.

19. The electrolytic cell of claim 17 wherein the barrier is asbestos or polymer reinforced asbestos.

20. The electrolytic cell of claim 17 wherein the barrier is a microporous fluorocarbon separator.

* * * * *